US009962598B2

(12) United States Patent
Yan et al.

(10) Patent No.: US 9,962,598 B2
(45) Date of Patent: May 8, 2018

(54) COURT MARKING SWITCHING SYSTEM

(71) Applicant: BOE TECHNOLOGY GROUP CO., LTD., Beijing (CN)

(72) Inventors: Junwei Yan, Beijing (CN); Hao Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 41 days.

(21) Appl. No.: 15/088,919

(22) Filed: Apr. 1, 2016

(65) Prior Publication Data

US 2017/0007912 A1 Jan. 12, 2017

(30) Foreign Application Priority Data

Jul. 6, 2015 (CN) ..... 2015 1 0391807

(51) Int. Cl.
*A63C 19/06* (2006.01)

(52) U.S. Cl.
CPC ..... *A63C 19/065* (2013.01); *A63C 2203/12* (2013.01); *A63C 2203/14* (2013.01)

(58) Field of Classification Search
CPC ..... A63C 19/065; A63C 19/00; A63C 19/06; A63B 61/00
See application file for complete search history.

(56) References Cited

U.S. PATENT DOCUMENTS

2007/0053201 A1* 3/2007 Dietz ..... G09F 19/22 362/559
2008/0254920 A1* 10/2008 Oresky ..... A63C 19/065 473/490
2009/0197710 A1* 8/2009 Ronda ..... A63B 71/0605 473/490

FOREIGN PATENT DOCUMENTS

| | | | |
|---|---|---|---|
| CN | 2448869 | Y | 9/2001 |
| CN | 202237179 | U | 5/2012 |
| CN | 103845888 | A | 6/2014 |
| CN | 103861273 | A | 6/2014 |
| CN | 203648024 | U | 6/2014 |
| CN | 204159012 | U | 2/2015 |
| CN | 204319733 | U | 5/2015 |
| DE | 202011108634 | U | 2/2012 |

(Continued)

OTHER PUBLICATIONS

Badminton Court, Feb. 25, 2011, p. 1, <http://www.badminton-information.com/badminton-court.html>.*

(Continued)

*Primary Examiner* — Gene Kim
*Assistant Examiner* — Alyssa Hylinski
(74) *Attorney, Agent, or Firm* — Kinney & Lange, P.A.

(57) ABSTRACT

Embodiments of the present invention relate to a court marking switching system, including: singles and doubles markings, wherein the singles and doubles markings present white color when they are not lit up, and present a same color with surrounding floor when they are lit up; a switching element which lights up the singles markings and turns off the doubles markings when receiving a doubles command and lights up the doubles markings and turns off the singles markings when receiving a singles command. During the doubles match, only the singles markings are lit up, the lit singles markings present a same color with that of the surrounding floor and are not easy to be observed, while the doubles markings which are not lit up present a white color, such that only the white doubles markings may be observed by a user.

9 Claims, 2 Drawing Sheets

(56) References Cited

FOREIGN PATENT DOCUMENTS

| | | | | | |
|---|---|---|---|---|---|
| GB | 2451856 | A | * | 2/2009 | ..... A63C 19/065 |
| JP | 2013248123 | A | | 12/2013 | |
| TW | 201200213 | A | * | 1/2012 | ..... A63C 19/06 |

OTHER PUBLICATIONS

Badminton Court, Feb. 25, 2011, p. 1 <http://badminton-information.com/badminton-court.html>.*
First Chinese Office Action, for Chinese Patent Application No. 2015103918077, dated Sep. 26, 2016, 18 pages.
Second Chinese Office Action, for Chinese Patent Application No. 2015103918077, dated Mar. 3, 2017, 18 pages.

* cited by examiner

COURT MARKING SWITCHING SYSTEM

CROSS-REFERENCE TO RELATED APPLICATION

This application claims the benefit of Chinese Patent Application No. 201510391807.7 filed on Jul. 6, 2015 in the State Intellectual Property Office of China, the whole disclosure of which is incorporated herein by reference.

FIELD OF INVENTION

The present invention relates to the field of display technology, especially relates to a court marking switching system.

BACKGROUND OF THE INVENTION

Currently, in a playing court for the match in which the number of participants is changeable, the markings of the court may be correspondingly changed when the number of participants is changed. For example, markings for a badminton court are shown in FIG. 1, they include singles court markings and doubles court markings which may be used for both singles events and doubles events. The present court may save space on basis of serving for various activities and can be used for multi-purposes with the same court. However, such court markings will disrupt the visual sense and judgment of the players, umpires and spectators for a certain area. For example, they may observe the boundary line of the double court markings when a single event is played.

SUMMARY OF THE INVENTION

The present invention has been made to switchably display different markings in various matches. For example, for a badminton court, the single court markings and double court markings are switchably shown so as to facility observation and judgment.

Accordingly, it is an object of the present invention to provide a court marking switching system which comprises: singles court markings, doubles court markings, and a switching element, the singles court markings and doubles court markings presenting a different color from that of a surrounding floor when they are not lit up and presenting the same color as that of the surrounding floor when they are lit up; the switching element is configured to light up the singles court markings and turn off the doubles court markings when receiving a doubles command, and light up the doubles court markings and turn off the singles court markings when receiving a singles command, or the singles court markings and doubles court markings presenting the same color as that of the surrounding floor when they are not lit up and presenting a different color from that of the surrounding floor when they are lit up; the switching element is configured to turn off the singles court markings and lights up the doubles court markings when receiving a doubles command and turn off the doubles court markings and light up the singles court markings when receiving a singles command.

Preferably, the singles court markings comprise: a first and second long side lines which are parallel to each other, a first and second short side lines which are parallel to each other, the first and second long side lines and the first and second short side lines forming a rectangular shape, the first and second long side lines having a length of 1340 cm, the first and second short side lines having a length of 510 cm; a first midline perpendicular to and bisecting the first short side line, and a second midline perpendicular to and bisecting the second short side line, the first and second midlines having a length of 464 cm; and a first and second mid court lines parallel to the first short side line, the first and second mid court lines having a length of 510 cm, the first midline being perpendicular to and bisecting the first mid court line, the second midline being perpendicular to and bisecting the second mid court line, wherein the singles court markings have a line width of 4 cm.

Preferably, the doubles court markings comprise: a third and fourth long side lines which are parallel to the first long side line, a third and fourth short side lines which are parallel to the first short side line, the third and fourth long side lines and the third and fourth short side lines forming a rectangular shape, the third and fourth long side lines having a length of 1340 cm, the third and fourth short side lines having a length of 602 cm, and the midpoint of the third short side line coinciding with that of the first short side line, the midpoint of the fourth short side line coinciding with that of the second short side line; the first midline perpendicular to and bisecting the third short side line, and the second midline perpendicular to and bisecting the fourth short side line; a third and fourth mid court lines parallel to the third short side line, the third and fourth mid court lines having a length of 602 cm, the first midline being perpendicular to and bisecting the third mid court line, the second midline being perpendicular to and bisecting the fourth mid court line, and a first and second back court lines parallel to the third short side line, the first and second back court lines having a length of 602 cm, the first midline being perpendicular to and bisecting the first back court line, the second midline being perpendicular to and bisecting the second back court line, the first back court line being spaced apart from the third short side line by 72 cm, and the second back court line being spaced apart from the fourth short side line by 72 cm, wherein the doubles court markings have a line width of 4 cm.

Preferably, the switching element is used for, according to a received command, lighting up one or more of the first, second, third and fourth long side lines, the first, second, third and fourth short side lines, the first and second midlines, the first, second, third and fourth mid court lines, and the first and second back court lines.

Preferably, the switching element is used for turning off all of the court markings according to a received command in case that the singles and doubles court markings present a different color from that of surrounding floor when they are not lit up and present a same color with that of surrounding floor when they are lit up, or the switching element is used for lighting up all of the court markings according to the received command in case that the singles and doubles court markings present a same color with that of surrounding floor when they are not lit up and present a different color from that of surrounding floor when they are lit up.

Preferably, when receiving a doubles command, the switching element lights up the markings of the singles court markings that are not superposed with the doubles court markings, and turns off the markings of the doubles court markings that are not superposed with the singles court markings, if the doubles court markings are lit up and the singles court markings are turned off, in case that the singles and doubles court markings present a different color from that of surrounding floor when they are not lit up and present a same color with that of surrounding floor when they are lit up, or the switching element turns off the markings of the singles court markings that are not superposed with the doubles court markings, and lights up the markings of the doubles court markings that are not superposed with the singles court markings, if the singles court markings are lit up and the doubles court markings are turned off, in case that the singles and doubles court markings present a same color with that of surrounding floor when they are not lit up and present a different color from that of surrounding floor when they are lit up.

Preferably, when receiving a singles command, the switching element turns off the markings of the singles court markings that are not superposed with the doubles court markings, and lights up the markings of the doubles court markings that are not superposed with the singles court markings, if the singles court markings are lit up and the doubles court markings are turned off, in case that the singles and doubles court markings present a different color from that of surrounding floor when they are not lit up and present a same color with that of surrounding floor when they are lit up, or the switching element lights up the markings of the singles court markings that are not superposed with the doubles court markings, and turns off the markings of the doubles court markings that are not superposed with the singles court markings, if the doubles court markings are lit up and the singles court markings are turned off, in case that the singles and doubles court markings present a same color with that of surrounding floor when they are not lit up and present a different color from that of surrounding floor when they are lit up.

Preferably, the singles and doubles court markings include: a light guide plate and a plurality of LED lights arranged on both sides of the light guide plate, wherein the LED lights cause the light guide plate to present a same color with that of the surrounding floor when they are lit up, in case that the singles and doubles court markings present a different color from that of surrounding floor when they are not lit up and present a same color with that of surrounding floor when they are lit up; or the LED lights cause the light guide plate to present the different color from the surrounding floor when they are lit up, the singles and doubles court markings present a same color with that of surrounding floor when they are not lit up and present a different color from that of surrounding floor when they are lit up; wherein the switch element turns on or turns off the LED lights according to the received command.

Preferably, the LED lights cause the light guide plate to present a grass green color when they are lit up, in case that the singles and doubles court markings present a different color from that of surrounding floor when they are not lit up and present a same color with that of surrounding floor when they are lit up; or the LED lights cause the light guide plate to present a white color when they are lit up, the singles and doubles court markings present a same color with that of surrounding floor when they are not lit up and present a different color from that of surrounding floor when they are lit up.

Preferably, the singles and doubles court markings further include: an anti-slip film which is covered above the LED lights and the light guiding plate and transmits light rays emitted by the LED lights through the light guiding plate when the LED lights are lit up, wherein the anti-slip film presents a white color when the LED lights are not lit up, in case that the singles and doubles court markings present a different color from that of surrounding floor when they are not lit up and present a same color with that of surrounding floor when they are lit up; or the anti-slip film presents a grass green color when the LED lights are not lit up, in case that the singles and doubles court markings present a same color with that of surrounding floor when they are not lit up and present a different color from that of surrounding floor when they are lit up.

With above described solutions, only the singles court markings are lit up when doubles events are played, as the lit singles court markings present a same color with that of the surrounding floor and are not easy to be observed, while the unlit doubles court markings present a white color, which causes the umpires, players and spectators will only observe the white double court markings. Similarly, only the doubles court markings are lit up when singles events are played, as the lit doubles court markings present a same color with that of the surrounding floor and are not easy to be observed, while the unlit singles court markings present a white color, which causes the umpires, players and spectators will only observe the white singles court markings.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF PREFERRED EMBODIMENTS OF THE INVENTION

Exemplary embodiments of the present disclosure will be described hereinafter in detail with reference to the attached drawings. It should be noted that various features described in different embodiments may be freely combined with each other without conflicting in configuration or principle.

In the following description, for purposes of explanation, numerous specific details are set forth in order to provide a thorough understanding of the disclosed embodiments. The present disclosure may, however, be embodied in many different forms and should not be construed as being limited to the embodiment set forth herein. Below, a marking switching system for a badminton court will be used as an example to describe the present invention in detail. It should be noted that the present embodiment should not limit to the present invention and the embodiment of the present invention may include other playing court for the match in which the numbers of participants are changeable, such as a tennis court and a volleyball court.

Figure 1:
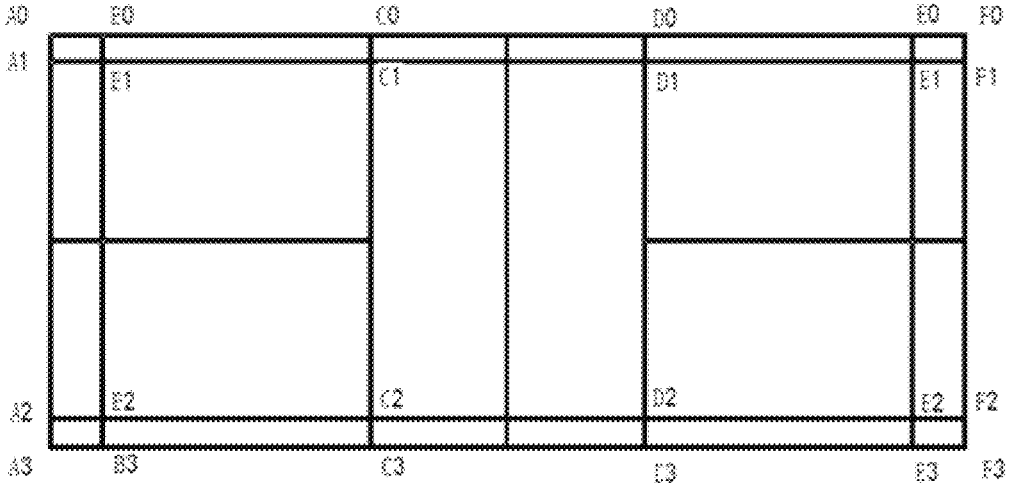
FIG. 1 is an illustrative view of a badminton court markings in the prior art.

Accordingly, according to an embodiment of the present invention, a court marking switching system comprises: singles and doubles court markings, wherein the singles and doubles court markings present a different color from that of surrounding floor when they are not lit up and present a same color with that of surrounding floor when they are lit up; and a switching element which lights up the singles court markings and turns off the doubles court markings when receiving a doubles command. As shown in FIG. 1, the rectangle formed by line segments A0F0, F0F3, F3A3 and A3A0 is the doubles area, in which some doubles court markings such as B0B3, C0C3, D0D3 and E0E3 and two midlines.

By only lighting up the singles marks when doubles events are played, as the lit singles court markings present a same color with that of the surrounding floor and are not easy to be observed, while the unlit doubles court markings present a different color from that of the surrounding floor, preferably present a white color, which causes the umpires, players and spectators will only observe the white doubles court markings.

Figure 3:
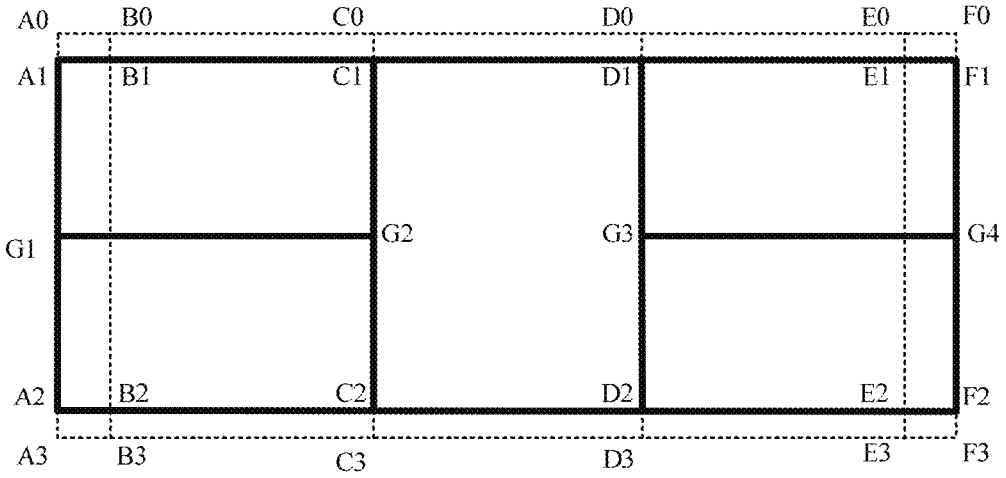
FIG. 3 is a displaying view of singles court markings according to an embodiment of the present invention.

The switching element lights up the doubles court markings and turns off the singles court markings when receiving a singles command. As shown in FIG. 3, the rectangle formed by a first and second long side lines A1F1, A2F2, a first and second short side lines A1A2,F1F2, is the singles area, in which some singles court markings such as a line segment B1B2, a first and second mid court lines C1C2, D1D2, a line segment E1E2 and the first and second midlines G1G2, G3G4.

Only the doubles court markings are lit up when singles events are played, as the lit doubles court markings present a same color with that of the surrounding floor and are not easy to be observed, while the unlit singles court markings present a different color from that of the surrounding floor, preferably present a white color, which causes the umpires, players and spectators will only observe the white singles court markings.

Above is only an embodiment of the present invention, in which the case that the singles and doubles court markings present a different color from that of surrounding floor when they are not lit up and present a same color with that of surrounding floor when they are lit up is used to illustrate the effect of the present invention. Actually, the case that the singles and doubles court markings present a same color with that of surrounding floor when they are not lit up and present a different color from that of surrounding floor when they are lit up may be provided as desired. Under such a situation, the switching element turns off the singles court markings and lights up the doubles court markings when receiving a doubles command, while it turns off the doubles court markings and lights up the singles court markings when receiving a singles command. It also can achieve an effect that only the current necessary court markings may be observed and the unnecessary court markings will not be observed.

To facilitate the description, the effect of the invention will be described hereinafter with the case that the singles and doubles court markings present a different color from that of surrounding floor when they are not lit up and present a same color with that of surrounding floor when they are lit up.

The embodiment of the present invention achieves the object to switch the singles and doubles court markings, such that the players, umpires and spectators will only observe the court markings relevant to the current match and will not observe the court markings irrelevant to the current match, so as to facilitate observation of the players, umpires and spectators, avoiding other court markings causing visual disturbance to the players and umpires, improving accuracy of judgment of the player for the falling position of the badminton.

Preferably, the singles court markings comprise: a first and second long side lines which are parallel to each other, a first and second short side lines which are parallel to each other, the first and second long side lines and the first and second short side lines forming a rectangular shape, the first and second long side lines having a length of 1340 cm, the first and second short side lines having a length of 510 cm; a first midline perpendicular to and bisecting the first short side line, and a second midline perpendicular to and bisecting the second short side line, the first and second midlines having a length of 464 cm; and a first and second mid court lines parallel to the first short side line, the first and second mid court lines having a length of 510 cm, the first midline being perpendicular to and bisecting the first mid court line, the second midline being perpendicular to and bisecting the second mid court line, wherein the singles court markings have a line width of 4 cm.

As shown in FIG. 3, the setting of the line width and the line length of the court markings according to the present embodiment, a singles court markings with a length of 1340 cm, a width of 518 cm (that is 510 cm+2×4 cm) and a line width of 4 cm will be formed, which complies with standard of the singles court of the International Badminton Federation.

Preferably, the doubles court markings comprise: a third and fourth long side lines which are parallel to the first long side line, a third and fourth short side lines which are parallel to the first short side line, the third and fourth long side lines and the third and fourth short side lines forming a rectangular shape, the third and fourth long side lines having a length of 1340 cm, the third and fourth short side lines having a length of 602 cm, and the midpoint of the third short side line coinciding with that of the first short side line, the midpoint of the fourth short side line coinciding with that of the second short side line; a first midline perpendicular to and bisecting the third short side line, and a second midline perpendicular to and bisecting the fourth short side line; a third and fourth mid court lines parallel to the third short side line, the third and fourth mid court lines having a length of 602 cm, the first midline being perpendicular to and bisecting the third mid court line, the second midline being perpendicular to and bisecting the fourth mid court line, and a first and second back court lines parallel to the third short side line, the first and second back court lines having a length of 602 cm, the first midline being perpendicular to and bisecting the first back court line, the second midline being perpendicular to and bisecting the second back court line, the first back court line being spaced apart from the third short side line by 72 cm, and the second back court line being spaced apart from the fourth short side line by 72 cm. The doubles court markings have a line width of 4 cm.

Figure 2:
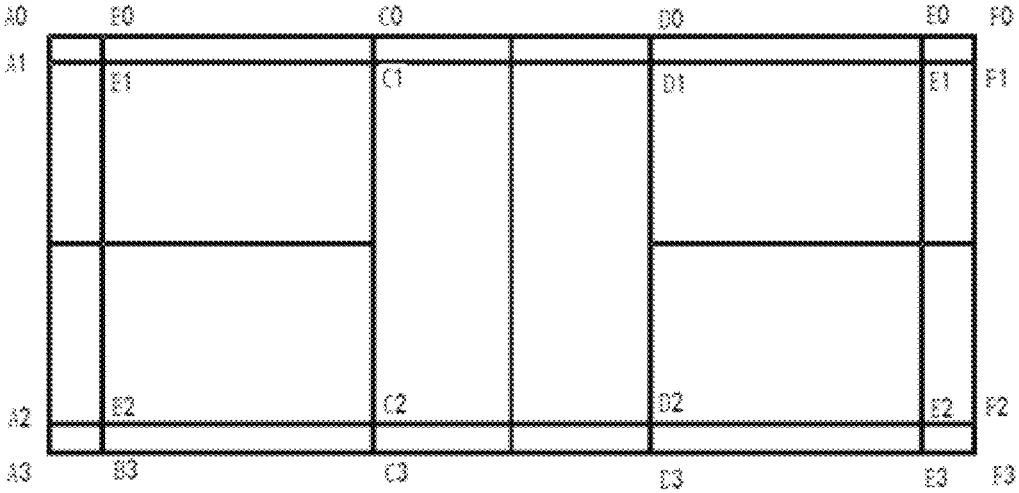
FIG. 2 is a displaying view of doubles court markings according to an embodiment of the present invention.

As shown in FIG. 2, the setting of the line width and the line length of the markings according to the present embodiment, a doubles marking with a length of 1340 cm, a width of 610 cm (that is 602 cm+2×4 cm) and a line width of 4 cm will be formed, which complies with standard of the doubles court of the International Badminton Federation.

Preferably, the switching element is used for, according to a received command, lighting up one or more of the first, second, third and fourth long side lines, the first, second, third and fourth short side lines, the first and second midlines, the first, second, third and fourth mid court lines, and the first and second back court lines.

As the markings are laid under the ground, it may cause circuit failure possibly due to soaking by the rain or frequent treaded by personals. By lighting up the markings one by one, it will be quickly and accurately determined the circuit of which marking is failed, such that a local test and determination may be performed.

Preferably, the switching element is used for turning off all of the markings according to a received command, in case that the singles and doubles court markings present a different color from that of surrounding floor when they are not lit up and present a same color with that of surrounding floor when they are lit up, or the switching element is used for lighting up all of the markings according to the received command in case that the singles and doubles court markings present a same color with that of surrounding floor when they are not lit up and present a different color from that of surrounding floor when they are lit up.

It makes both the singles and doubles court markings in the badminton court easy to be viewed, which is convenient for one who gets used to seeing both the singles and doubles court markings.

Preferably, when receiving a doubles command, the switching element lights up the markings of the singles court markings that are not superposed with the doubles court markings, and turns off the markings of the doubles court markings that are not superposed with the singles court markings, if the doubles court markings are lit up and the singles court markings are turned off, in case that the singles and doubles court markings present a different color from that of surrounding floor when they are not lit up and present a same color with that of surrounding floor when they are lit up.

In the present embodiment, there are some superposed line segments in the doubles and singles court markings, as shown in FIG. 2, the first short side line A1A2, line segment B1B2, the first mid court line C1C2, the second mid court line D1D2, line segment E1E2, the second short side line F1F2 and the first midline G1G2, the second midline G3G4 are the superposed line segments in the doubles and singles court markings. Therefore, when a singles match is switched to a doubles match, lighting up doubles court markings should be switched to lighting up singles court markings, such that the doubles court markings are easy to be observed. As the above mentioned superposed line segments are already in a state of being turned off, it is not necessary to operate the above mentioned line segments again, and it is only necessary to light up the markings of the singles court markings which are not superposed with the double court markings, that is, the first and second long side lines A1F1, A2F2, and turn off the markings of the doubles court markings which are not superposed with the singles court markings, that is, the third and fourth long side lines A0F0, A3F3 and line segments B0B1, C0C1, D0D1, E0E1, B2B3, C2C3, D2D3 and E2E3, such that the singles court markings are not easy to be observed and doubles court markings are easy to be observed, achieving the display of the doubles court markings.

The boundary lines of the back court of tees of the double court are superposed, that is, the rectangle B0C0C3B3 and D0E0E3D3 are tees of the courts on both sides, the third short line side A0A3 and the fourth short line F0F3 are the boundary lines of the back court of the courts on both sides.

The switching element turns off the markings of the singles court markings that are not superposed with the doubles court markings, and lights up the markings of the doubles court markings that are not superposed with the singles court markings, if the singles court markings are lit up and the doubles court markings are turned off, in case that the singles and doubles court markings present a same color with that of surrounding floor when they are not lit up and present a different color from that of surrounding floor when they are lit up.

Preferably, when receiving a singles command, the switching element turns off the markings of the singles court markings that are not superposed with the doubles court markings, and lights up the markings of the doubles court markings that are not superposed with the singles court markings, if the singles court markings are lit up and the doubles court markings are turned off, in case that the singles and doubles court markings present a different color from that of surrounding floor when they are not lit up and present a same color with that of surrounding floor when they are lit up.

In the present embodiment, there are some superposed line segments in the doubles and singles court markings, as shown in FIG. 3, the first short side line A1A2, the first mid court line C1C2, the second mid court line D1D2 and the second short side line F1F2 and the first midline G1G2, the second midline G3G4 are the superposed line segments in the doubles and singles court markings. So when a doubles match is switched to a singles match, lighting up singles court markings should be switched to lighting up doubles court markings, such that the singles court markings are easy to be observed. As the above mentioned superposed line segments are already in a state of being turned off, it is not necessary to operate the above mentioned line segments again, and it is only necessary to turn off the markings of the singles court markings which are not superposed with the double court markings, that is, the first and second long side lines A1F1, A2F2, and lights up the markings of the doubles court markings which are not superposed with the singles court markings, that is, the third and fourth long side lines A0F0, A3F3, the first back court line B0B3 and line segments C0C1, D0D1, the second back court line E0E3, line segments B2B3, C2C3, D2D3 and E2E3, such that the doubles court markings are not easy to be observed and singles court markings are easy to be observed, achieving the display of the singles court markings.

The boundary line of the back court of tees of the singles court are superposed, that is, the rectangle A1C1C2B2 and D1E1E2D2 are tees of the courts on both sides, the first short line side A1A2 and the second short line F1F2 are the boundary lines of the back court of the courts on both sides.

the switching element lights up the markings of the singles court markings that are not superposed with the doubles court markings, and turns off the markings of the doubles court markings that are not superposed with the singles court markings, if the doubles court markings are lit up and the singles court markings are turned off, in case that the singles and doubles court markings present a same color with that of surrounding floor when they are not lit up and present a different color from that of surrounding floor when they are lit up.

Figure 4:
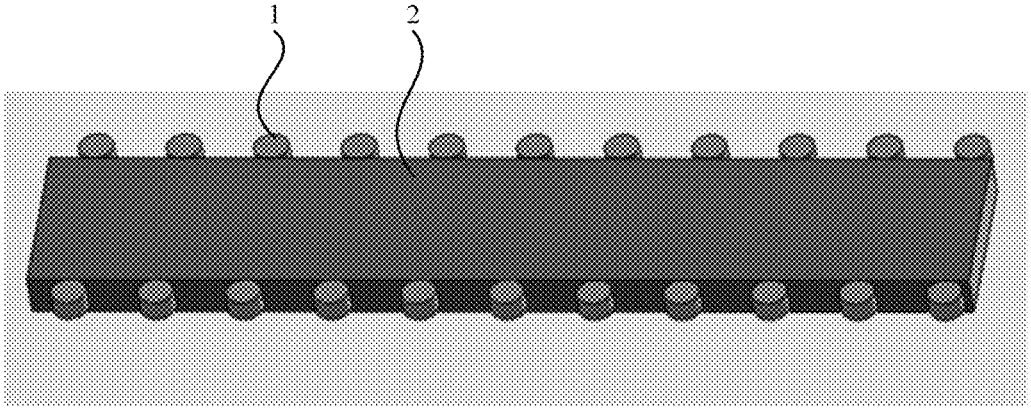
FIG. 4 is a structural view of the court markings according to an embodiment of the present invention.

As shown in FIG. 4, preferably, the singles and doubles court markings include: a light guide plate 2 and a plurality of LED lights 1 arranged on both sides of the light guide plate 2, the LED lights 1 cause the light guide plate 2 to present a same color with that of the surrounding floor when they are lit up, in case that the singles and doubles court markings present a different color from that of surrounding floor when they are not lit up and present a same color with that of surrounding floor when they are lit up; or the LED lights 1 cause the light guide plate 2 to present the different color from the surrounding floor when they are lit up, the singles and doubles court markings present a same color with that of surrounding floor when they are not lit up and present a different color from that of surrounding floor when they are lit up;

the switch element turns on or turns off the LED lights 1 according to a received command.

Markings with same or different color with or from the surrounding floor may be formed through cooperation of the LED lights 1 and the light guiding plates 2, so as to facilitate the observations.

Preferably, the LED lights 1 cause the light guide plate 2 to present a grass green color when they are lit up, in case that the singles and doubles court markings present a different color from that of surrounding floor when they are not lit up and present a same color with that of surrounding floor when they are lit up.

The LED lights 1 cause the light guide plate 2 to present a white color when they are lit up, the singles and doubles court markings present a same color with that of surrounding floor when they are not lit up and present a different color from that of surrounding floor when they are lit up.

The color of the court floor recommended by the International Badminton Federation is grass green, while the standard color of the markings are white color. The LED lights 1 cause the light guide plate 2 to present a grass green color when they are lit up, such that the color of the markings keep well consistent with those of the court floor and the marking are not easy to be observed, or The LED lights 1 cause the light guide plate 2 to present a white color when they are lit up, such that they can be well observed as markings.

Figure 5:
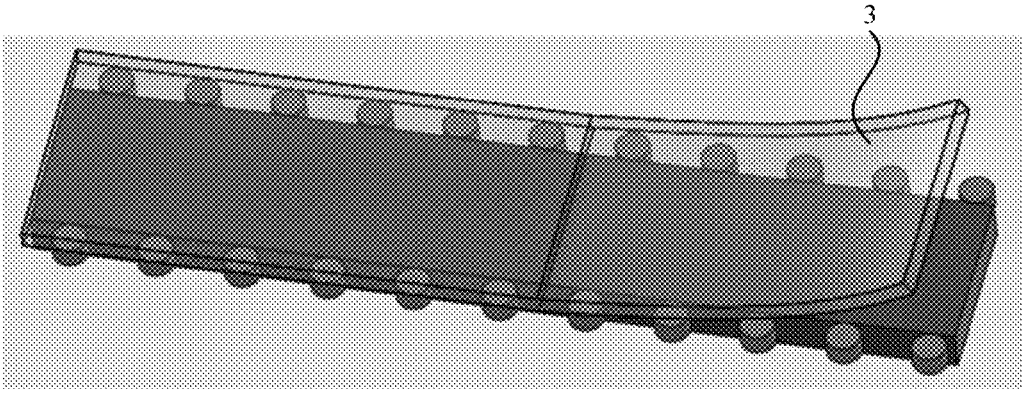
FIG. 5 is a structural view of the court markings according to another embodiment of the present invention.

As shown in FIG. 5, preferably, the singles and doubles court markings further include: an anti-slip film 3 which is covered on the LED lights 1 and the light guiding plate 2 and transmits light rays emitted by the LED lights 1 through the light guiding plate 2 when the LED lights 1 are lit up. The anti-slip film 3 presents a white color when the LED lights 1 are not lit up, in case that the singles and doubles court markings present a different color from that of surrounding floor when they are not lit up and present a same color with that of surrounding floor when they are lit up.

Because the anti-slip film 3 has a function of anti-slipping, it prevents the player from sliding down when they tread on the markings. Further, the anti-slip film 3 is covered above the LED lights 1 and the light guiding plate 2, and protects the LED lights 1 and the light guiding plate 2 from being damaged. It further assures the un-lit markings present a white color to facilitate observation of the umpires, players and spectators.

The anti-slip film 3 presents a grass green color when the LED lights 1 are not lit up, in case that the singles and doubles court markings present a same color with that of surrounding floor when they are not lit up and present a different color from that of surrounding floor when they are lit up.

In the above, the technical solutions of the present disclosure are described in detail with reference to the attached drawings. Considering that, in the prior art, the markings of the badminton court display the singles and doubles court markings simultaneously, which are not easy for the player and the umpires to observe them. With the described solutions of the present invention, only the singles court markings are lit up when doubles events are played, as the lit singles court markings present a same color with that of the surrounding floor and are not easy to be observed, while the unlit doubles court markings present a white color, which causes the umpires, players and spectators will only observe the white double court markings. Similarly, only the doubles marks are lit up when singles events are played, as the lit doubles court markings present a same color with that of the surrounding floor and are not easy to be observed, while the unlit singles court markings present a white color, which causes the umpires, players and spectators only to observe the white singles court markings.

It should be noted that the dimensions of the layer or the area are enlarged for the sake of clarity of illustration. Furthermore, it should be understood that, when an element or a layer is referred to be "on" another element or layer, it may be on other elements directly or there may be an intermediate layer. Furthermore, it should be understood that, when an element or a layer is referred to be "under" another element or layer, it may be under other elements directly or there may be one or more intermediate layers or elements. Furthermore, it should be understood that, when an element or a layer is referred to be "between" two elements or layers, it may be only one layer between two layers or two elements or there may be one or more intermediate layers or elements. The like reference numerals refer to the like elements throughout the present description.

In the present invention, terms "first", "second", "third" and "fourth" are only used for explanation, which should not be understood to teach or suggest the relative importance. Term "plurality" indicates two or more than two, unless there is a clear different definition.

It should be appreciated for those skilled in this art that the above embodiments are intended to be illustrated, and not restrictive. For example, many modifications may be made to the above embodiments by those skilled in this art, without departing from the principles and spirit of the disclosure, the scope of which is defined in the claims and their equivalents.

What is claimed is:

1. A court marking switching system, comprising:

singles court markings, doubles court markings, and a switching element, the singles court markings and doubles court markings presenting a different color from that of a surrounding floor when they are not lit up and presenting the same color as that of the surrounding floor when they are lit up; the switching element is configured to light up the singles court markings and turn off the doubles court markings when receiving a doubles command, and light up the doubles court markings and turn off the singles court markings when receiving a singles command, or the singles court markings and doubles court markings presenting the same color as that of the surrounding floor when they are not lit up and presenting a different color from that of the surrounding floor when they are lit up; the switching element is configured to turn off the singles court markings and lights up the doubles court markings when receiving a doubles command and turn off the doubles court markings and light up the singles court markings when receiving a singles command, wherein the singles and doubles court markings include:

a light guide plate and a plurality of LED lights arranged along opposing lateral edges of the light guide plate such that the LED lights are coplanar with the light guide plate, and wherein:

the LED lights are configured to be lit up such that the light guide plate presents the same color as that of the surrounding floor, when the singles and doubles court markings present a different color from that of the surrounding floor when they are not lit up and present the same color as that of the surrounding floor when they are lit up; or the LED lights are configured to be lit up such that the light guide plate presents a different color from that of the surrounding floor, when the singles and doubles court markings present the same color as that of the surrounding floor when they are not lit up and present a different color from that of the surrounding floor when they are lit up; and wherein the switching element is configured to turn on or turn off the LED lights according to a received command.

2. The court marking switching system according to claim 1, wherein the singles court markings comprise:

first and second long side lines which are parallel to each other, and first and second short side lines which are parallel to each other, the first and second long side lines and the first and second short side lines forming a rectangular shape, the first and second long side lines each having a length of 1340 cm, the first and second short side lines each having a length of 510 cm;

a first midline perpendicular to and bisecting the first short side line, and a second midline perpendicular to and bisecting the second short side line, the first and second midlines each having a length of 464 cm; and first and second mid court lines parallel to the first short side line, the first and second mid court lines each having a length of 510 cm, the first midline being perpendicular to and bisecting the first mid court line, the second midline being perpendicular to and bisecting the second mid court line, wherein the singles court marking has a line width of 4 cm.

3. The court marking switching system according to claim 2, wherein the doubles court markings comprise:

third and fourth long side lines which are parallel to the first long side line, and third and fourth short side lines which are parallel to the first short side line, the third and fourth long side lines and the third and fourth short side lines forming a rectangular shape, the third and fourth long side lines each having a length of 1340 cm, the third and fourth short side lines each having a length of 602 cm, and the midpoint of the third short side line coinciding with that of the first short side line, the midpoint of the fourth short side line coinciding with that of the second short side line, the first midline being perpendicular to and bisecting the third short side line, and the second midline being perpendicular to and bisecting the fourth short side line;

third and fourth mid court lines parallel to the third short side line, the third and fourth mid court lines each having a length of 602 cm, the first midline being perpendicular to and bisecting the third mid court line, the second midline being perpendicular to and bisecting the fourth mid court line; and first and second back court lines parallel to the third short side line, the first and second back court lines each having a length of 602 cm, the first midline being perpendicular to and bisecting the first back court line, the second midline being perpendicular to and bisecting the second back court line, the first back court line being spaced apart from the third short side line by 72 cm, and the second back court line being spaced apart from the fourth short side line by 72 cm, wherein the doubles court marking has a line width of 4 cm.

4. The court marking switching system according to claim 3, wherein the switching element is also used for, according to a received command, lighting up one or more of the first, second, third and fourth long side lines, the first, second, third and fourth short side lines, the first and second midlines, the first, second, third and fourth mid court lines, and the first and second back court lines.

5. The court marking switching system according to claim 3, wherein the switching element is used for turning off all of the markings according to a received command when the singles and doubles court markings present a different color from that of the surrounding floor when they are not lit up and present the same color as that of the surrounding floor when they are lit up, or the switching element is used for lighting up all of the markings according to a received command when the singles and doubles court markings present the same color as that of the surrounding floor when they are not lit up and present a different color from that of the surrounding floor when they are lit up.

6. The court marking switching system according to claim 1, wherein, the switching element is configured to, when receiving a doubles command and when the doubles court markings are lit up and the singles court markings are turned off, light up the markings of the singles court markings that are not superposed with the doubles court markings, and turn off the markings of the doubles court markings that are not superposed with the singles court markings, when the singles and doubles court markings present a different color from that of the surrounding floor when they are not lit up and present the same color as that of the surrounding floor when they are lit up, or the switching element is configured to, when receiving a doubles command and when the singles court markings are lit up and the doubles court markings are turned off, turn off the markings of the singles court markings that are not superposed with the doubles court markings, and light up the markings of the doubles court markings that are not superposed with the singles court markings, when the singles and doubles court markings present the same color as that of the surrounding floor when they are not lit up and present a different color from that of the surrounding floor when they are lit up.

7. The court marking switching system according to claim 1, wherein the switching element is configured to, when receiving a singles command and when the singles court markings are lit up and the doubles court markings are turned off, turn off the markings of the singles court markings that are not superposed with the doubles court markings, and light up the markings of the doubles court markings that are not superposed with the singles court markings, when the singles and doubles court markings present a different color from that of the surrounding floor when they are not lit up and present the same color as that of the surrounding floor when they are lit up, or the switching element is configured to, when receiving a singles command and when the doubles court markings are lit up and the singles court markings are turned off, light up the markings of the singles court markings that are not superposed with the doubles court markings, and turn off the markings of the doubles court markings that are not superposed with the singles court markings, when the singles and doubles court markings present the same color as that of the surrounding floor when they are not lit up and present a different color from that of the surrounding floor when they are lit up.

8. The court marking switching system according to claim 1, wherein the LED lights are configured to be lit up such that the light guide plate presents a grass green color, when the singles and doubles court markings present a different color from that of the surrounding floor when they are not lit up and present the same color as that of the surrounding floor when they are lit up; or the LED lights are configured to be lit up such that the light guide plate presents a white color, when the singles and doubles court markings present the same color as that of the surrounding floor when they are not lit up and present a different color from that of the surrounding floor when they are lit up.

9. The court marking switching system according to claim 1, wherein the singles and doubles court markings further include:

an anti-slip film which covers the LED lights and the light guiding plate and is configured to transmit light rays emitted by the LED lights through the light guiding plate when the LED lights are lit up, wherein the anti-slip film presents a white color when the LED lights are not lit up, when the singles and doubles court markings present a different color from that of the surrounding floor when they are not lit up and present the same color as that of the surrounding floor when they are lit up; or the anti-slip film presents a grass green color when the LED lights are not lit up, when the singles and doubles court markings present the same color as that of the surrounding floor when they are not lit up and present a different color from that of the surrounding floor when they are lit up.

* * * * *